United States Patent [19]

Andersen

[11] 4,064,413

[45] Dec. 20, 1977

[54] RELAY ADAPTER CIRCUIT FOR TRAILER LAMPS

[75] Inventor: Poul H. Andersen, Royal Oak, Mich.

[73] Assignee: Chrysler Corporation, Highland Park, Mich.

[21] Appl. No.: 615,437

[22] Filed: Sept. 22, 1975

[51] Int. Cl.[2] ..... H05B 37/00; H05B 39/09

[52] U.S. Cl. ..... 315/77; 307/10 LS; 315/83; 340/81 R; 340/67

[58] Field of Search ..... 315/77, 80, 82, 83; 339/119 R, 10, ; 340/54, 55, 67, 73, 74, 81 R, 78; 317/123; 307/10 LS

[56] References Cited

U.S. PATENT DOCUMENTS

| | | | |
|---|---|---|---|
| 2,748,322 | 5/1956 | Oswald | 317/123 |
| 3,504,338 | 3/1970 | Breece | 340/67 |
| 3,789,232 | 1/1974 | Wareing | 340/81 R |
| 3,883,845 | 5/1975 | DeVita | 340/67 |
| 3,896,415 | 7/1975 | Carter | 340/78 |
| 3,970,860 | 7/1976 | Purdy | 307/10 LS |
| 4,006,453 | 2/1977 | Bryant | 340/67 |

*Primary Examiner*—Eugene R. LaRoche
*Attorney, Agent, or Firm*—Baldwin & Newtson

[57] ABSTRACT

A relay adapter circuit is electrically connected with the existing stop lamp and turn signal lamp systems of a motor vehicle and with the existing lamps on a trailer towed by the motor vehicle. The adapter is especially suited for installation where the vehicle has separate stop and turn signal lamp circuits on each side of the vehicle and the trailer has only a single lamp circuit on each side. The adapter achieves combined stop/turn signal capability in the trailer lamps.

5 Claims, 1 Drawing Figure

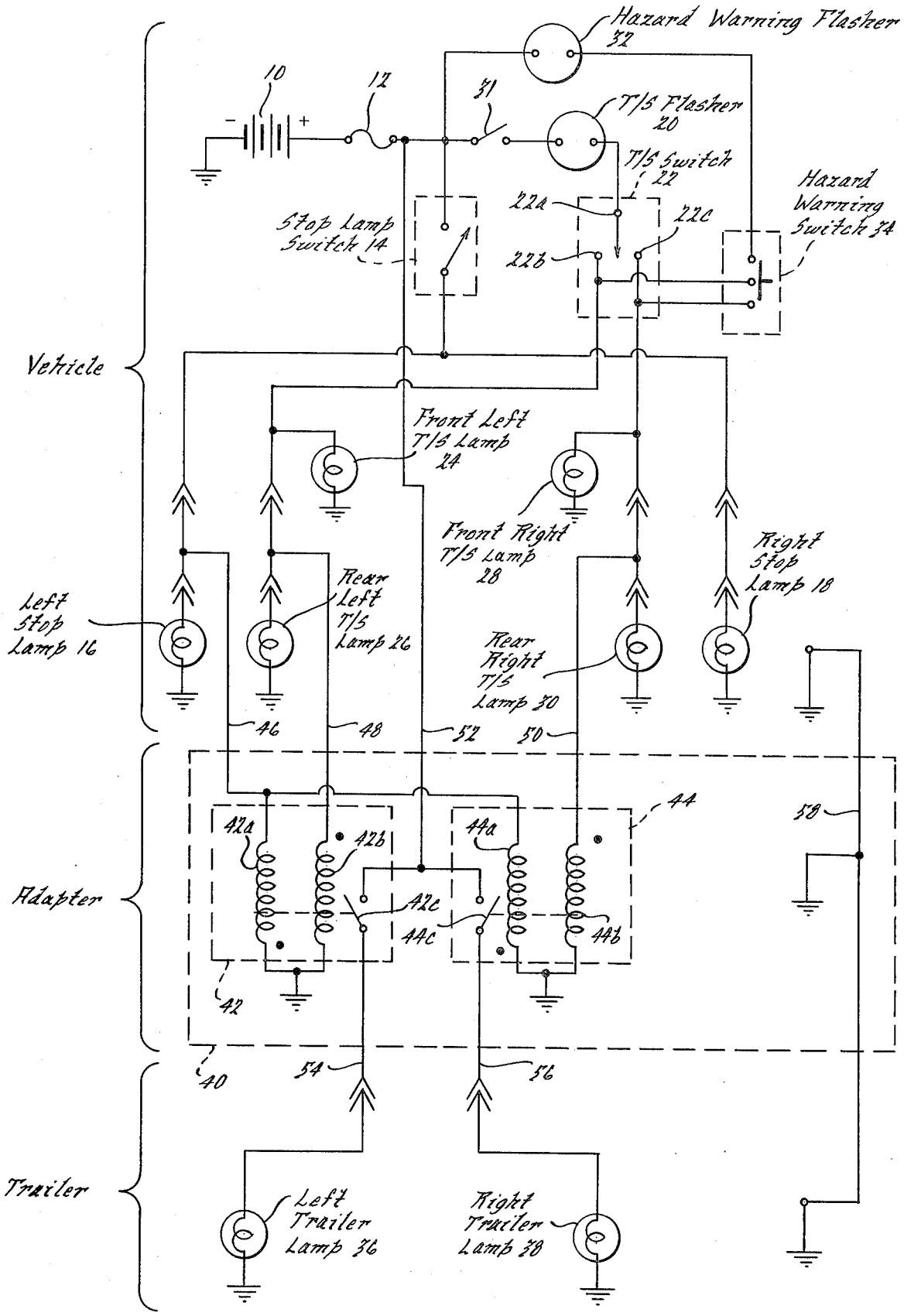
Hazard Warning Flasher 32
10
12
31
T/S Flasher 20
T/S Switch 22
22a
22b
22c
Stop Lamp Switch 14
Hazard Warning Switch 34
Vehicle
Front Left T/S Lamp 24
Front Right T/S Lamp 28
Right Stop Lamp 18
Left Stop Lamp 16
Rear Left T/S Lamp 26
Rear Right T/S Lamp 30
46
48
52
50
44
58
42a
42b
44a
Adapter
42c
44c
44b
42
40
54
56
Trailer
Left Trailer Lamp 36
Right Trailer Lamp 38

RELAY ADAPTER CIRCUIT FOR TRAILER LAMPS

BACKGROUND AND SUMMARY OF THE INVENTION

This invention pertains to lamp systems for over-the-road vehicles and in particular to a novel relay adapter circuit for adapting the existing stop/turn signal systems of a motor vehicle with the existing lamp system on a trailer towed by the motor vehicle.

Where a trailer is towed by a motor vehicle, the existing stop and turn signal lamp systems on the vehicle must be electrically connected with lamps on the trailer so that the trailer lamps can also provide the appropriate stop and turn signal indications to any vehicle which may be following the trailer. The trailer typically has a single lamp circuit on each side and may have one or more lamps in each circuit. Where the existing motor vehicle stop lamp and turn signal lamp systems incorporate stop and turn signal functions in a single lamp circuit on each side of the vehicle, the existing lamp circuit on each side of the trailer may be connected in parallel with the load in the corresponding vehicle lamp circuit and a heavy duty turn signal flasher may replace the existing vehicle flasher for handling the extra electrical load occasioned by the trailer lamps. Because the existing vehicle stop lamp and turn signal lamp systems of this type utilize a common lamp (or lamps) on each side of the vehicle for combined stop and turn signal function capability, the connection of the trailer lamps in parallel with the vehicle lamps causes the trailer lamp on each side to operate in exactly the same manner as the vehicle lamp (or lamps) on the corresponding side. Where the motor vehicle has separate stop and turn signal lamp circuits on each side of the vehicle and where the trailer likewise has separate stop and turn signal lamp circuits on each side, each trailer circuit may be connected directly in parallel with the load in the corresponding vehicle lamp circuit and a heavy duty flasher may replace the existing vehicle flasher to handle the additional load. However, where the motor vehicle has separate stop and turn signal lamp circuits on each side, a problem arises where the trailer has only a single lamp circuit on each side.

The present invention provides a solution to this problem so that the single lamp circuit on each side of the trailer can accomplish both stop and turn signal functions. Briefly, the present invention provides, in a presently preferred embodiment thereof, a relay adapter circuit which is electrically connected with the existing vehicle stop lamp and turn signal lamp systems and with the lamp systems on the trailer. The adapter can be readily electrically connected with both the vehicle and the trailer without need to rewire any circuits, to add extra lamps on the trailer, or even to replace existing vehicle components, such as the flasher, with heavier duty devices. Moreover, the adapter itself comprises only a small number of components and hence is quite economical.

The adapter circuit can also be used, if desired, as a conventional relay device in a vehicle having a single combined stop/turn signal lamp circuit on each side so that the trailer lamps operate in exact correspondence with the vehicle lamps; this usage has the advantage of not requiring heavier duty components, such as flashers and switches, in the existing vehicle system.

The foregoing features along with additional advantages and benefits of the invention will be seen in the ensuing description and claims which are to be considered in conjunction with the accompanying drawing.

BRIEF DESCRIPTION OF THE DRAWING

The drawing illustrates a preferred embodiment of the invention according to the best mode presently contemplated in carrying out the invention.

The single drawing FIGURE illustrates an electrical schematic diagram of the relay adapter circuit according to the present invention connected with the stop lamp and turn signal lamp systems of a vehicle and with the existing lamp system of a trailer.

DESCRIPTION OF THE PREFERRED EMBODIMENT

In the drawing the existing vehicle stop lamp system and turn signal lamp system are both illustrated. Both systems are powered from the vehicle battery 10 through a fuse 12. The stop lamp system includes a stop lamp switch 14, a left hand stop lamp 16 and a right hand stop lamp 18. Although only a single lamp is shown to be employed on each side of the vehicle, it will be appreciated that the specific number of stop lamps employed on the vehicle has no bearing on the present invention. From consideration of the drawing, the reader will appreciate that whenever the normally open stop lamp switch is closed, both stop lamps 16 and 18 are lighted by energizing current which flows from battery 10 through fuse 12 and stop lamp switch 14 to the lamps.

The turn signal system for the vehicle includes a conventional turn signal flasher 20, a turn signal selector switch 22, a left front turn signal lamp 24, a left rear turn signal lamp 26, a right front turn signal lamp 28 and a right rear turn signal lamp 30. Power for the turn signal lamp system is supplied through the usual vehicle ignition switch 31 so that it is necessary for the ignition switch to be "on", before the turn signal flasher system can be effective. As can be seen from consideration of the drawing, the battery terminal **22*a* of turn signal switch 22 connects through flasher 20 and ignition switch 31 to the load side of fuse 12. The left front and rear turn signal lamps 24 and 26 are connected to one load terminal 22*b* of turn signal switch 22 while the right front and rear turn signal lamps 28 and 30 are connected to the other load terminal 22*c*** of the turn signal switch. The turn signal switch is illustrated in the off position.

With this arrangement the left turn signal lamps 24 and 26 will be flashed when the turn signal switch is operated to complete a circuit between terminals **22*a* and 22*b*, and the right turn signal lamps 28 and 30 will be flashed when the turn signal switch is operated to complete the circuit between terminals 22*a* and 22*c***. It will be appreciated that the number of turn signal lamps on each side of the vehicle is not crucial to the present invention so long as at least one turn signal is provided on each side.

The drawing also illustrates a hazard warning system including a hazard warning flasher 32 and a hazard waring switch 34. The hazard warning system serves to flash all turn signal lamps when the hazard warning switch is actuated.

The relay adapter circuit according to the present invention is concerned with adapting the vehicle stop lamp and turn signal lamp systems, just described, with lamps provided on a trailer which is to be towed by the motor vehicle. In the illustrated embodiment the trailer is provided with a single left trailer lamp circuit including a single left trailer lamp 36 and a single right trailer lamp circuit including a single right trailer lamp 38. Here again the number of lamps in each of the single lamp circuits does not bear on the present invention. In order to connect the trailer lamps 36 and 38 with the vehicle stop lamp and turn signal lamp systems, in accordance with the principles of the present invention there is provided a relay adapter unit 40 which is electrically connected with the existing lamp sytems. The adapter unit 40 comprises a pair of identical relay assemblies 42 and 44, there being one relay assembly associated with the right hand side and the other with the left hand side.

Considering relay assembly 42 in detail, the reader will observe that it comprises a first coil portion **42*a*, a second coil portion 42*b* and a set of normally open contacts 42*c*. The two coil portions 42*a* and 42*b* are arranged and constructed using known principles such that when energizing current flows in only one of the two coil portions, a magnetic force is developed to close contacts 42*c*. Further, the two coil portions 42*b* are magnetically coupled with each other such that when energizng current flows in both coil portions 42*a* and 42*b* simultaneously, there is insufficient magnetic force developed to maintain contacts 42*c* in the closed condition, and hence the contacts open. One way of constructing relay 42 to accomplish this mode of operation is to wind the two coil portions 42*a* and 42*b* with equal numbers of ampere-turns but of opposite magnetic polarity, about a common magnetic flux path. Thus, when both coil portions are energized, the magnetic force of one cancels that of the other so that contacts 42*c* will be open. It is also beneficial to make the coil portions of sufficiently large impedance that they do not draw an appreciable amount of current when energized so that the existing flasher may continue to be used. The construction of relay 44 is identical and the designation of its constituent elements by the reference numerals 44*a*, 44*b* and 44*c* will be readily apparent in view of the preceding description of relay 42**.

The adapter unit is electrically connected in circuit in the following fashion. Coil portions **42*a* and 44*a* are connected via a conductor wire 46 with the load terminal of stop lamp switch 14 so that the two coil portions 42*a*, 44*a* are in parallel with the vehicle stop lamps 16 and 18. Wire 46 can terminate in a jumper connector which may be inserted into the circuit connection from the stop lamp switch to one of the stop lamps. Coil portion 42*b* is connected by a conductor wire 48 with the load contact 22*b* of turn signal switch 22 so that coil portion 42*b* is in parallel with the left turn signal lamps 24 and 26. Coil portion 44*b* is electrically connected via a conductor wire 50 with the load terminal 22*c* of turn signal switch 22 so that the coil portion 44*b* is in parallel with the right turn signal lamps 28 and 30. A conductor wire 52 connects one side of the contacts 42*c* and 44*c* with the load side of fuse 12 while a conductor wire 54 connects the load side of contacts 42*c* with the left trailer lamp 36 and a conductor wire 56 connects the load side of contacts 44*c* with the right trailer lamp 38. A common ground wire 58** provides a ground return path to the vehicle from the trailer and the adapter unit.

The adapter unit functions in the following fashion. When stop lamp switch 14 is closed (the turn signal switch 22 not being actuated), coil portions **42*a* and 44*a* are energized concurrently with lamps 16 and 18. The energization of coils 42*a*, 44*a* causes the corresponding relay contacts 42*c*, 44*c* to close thereby concurrently energizing the trailer lamps 36 and 38. Thus, when the vehicle operator applies the brakes of the vehicle, stop lamps 16, 18 on the vehicle and the lamps 36 and 38** on the trailer are continuously energized.

When turn signal switch 22 is actuated for a left hand turn (the stop lamp switch not being actuated), coil **44*b* will be energized concurrently with the left turn signal lamps 24 and 26. Energization of the coil 42*b* causes closure of contacts 42*c* so that the left hand trailer lamp 36 is energized concurrently with lamps 24 and 26. Thus, when the operator actuates switch 22 for a left hand turn, the lamps 24, 26 and 36** flash in unison. The operation for a right hand turn is analogous.

When both stop lamp switch 14 and turn signal switch 22 are simultaneously actuated, the operation is as follows. Assume that the turn signal switch is operated to indicate a left hand turn. The closure of stop lamp switch 14 will energize the right hand stop lamp 18, the left hand stop lamp 16 and the two coil portions **42*a*, 44*a*. Actuation of turn signal switch 22 to complete a circuit between terminals 22*a* and 22*b* will cause lamps 24, 26 and coil portion 42*b* to be concurrently energized from flasher 20. Relay coil 44*b* remains unenergized. Because only one of the two coil portions 44*a*, 44*b* of relay 44 is energized, the right hand trailer lamp 38 remains on continuously, as do the right and left vehicle stop lamps 16 and 18. Because the vehicle's left turn signal lamps 24 and 26 are energized through flasher 20, they will be flashed to indicate the left hand turn condition. Because coil 42*b* is intermittently energized from flasher 20 in unison with the energization of the lamps 24 and 26 from flasher 20, contacts 42*c* are intermittently actuated, the contacts being open with energization of both coils 42*a* and 42*b* and being closed when coil 42*b* is de-energized. Thus, the left trailer lamp 36 under this condition, flashes exactly out of phase with the flashing of the turn signal lamps 24 and 26**. Thus, where a turn signal indication in one direction is given concurrently with application of the vehicle brakes, the invention enables the trailer lamps to indicate both the braking of the vehicle and the direction of the indicated turn.

When the hazard warning system is actuated by closure of switch 34, the trailer lamps will flash in phase with the vehicle turn signal lamps if the stop lamp switch is not actuated and out of phase, if the stop lamp switch is actuated.

The relay adapter of the invention also has the advantage of being "polarity-insensitive" whereby it may be used in either a positive or negative ground system. Furthermore, the adapter may be used, if desired, as a conventional relay device in a vehicle having a single combined stop/turn signal lamp circuit on each side so that the trailer lamps operate in exact correspondence with the vehicle lamps. For this usage either coil **42*a* or 42*b* (but not both) of relay 42 is connected to the vehicle left stop/turn signal circuit, and either coil 44*a* or 44*b* (but not both) of relay 44** is connected to the vehicle right stop/turn signal circuit.

What is claimed is:

1. In a vehicle having an existing stop lamp system which is controllably energizable from the vehicle battery to controllably energize a stop lamp thereof and having an existing turn signal lamp system which is controllably energizable to controllably intermittently energize a turn signal lamp thereof from the battery, in combination with a vehicle towed by said first-named vehicle and having a signal lamp, an adapter unit for electrically coupling the towed vehicle signal lamp with the stop lamp and turn signal lamp systems of the first-named vehicle, said adapter unit comprising:

a circuit for electrically coupling said signal lamp with the battery and not with the vehicle stop lamp system nor with the vehicle turn signal lamp system, said circuit including switch means for electrically coupling said signal lamp with the vehicle battery such that when the switch means is actuated, the signal lamp is energized from the battery and when the switch means is not actuated, the signal lamp is not energized from the battery;

means for controlling the actuation of said switch means comprising first and second control elements each of which is adapted to be energized from the battery, means coupling said first control element with the stop lamp system, such that said first control element is energized from the battery whenever the stop lamp is energized, means coupling the second control element with the turn signal lamp system such that said second control element is energized from the battery whenever the turn signal lamp is energized, and means coupling said two control elements and said switch means together such that when neither of said control elements is energized, said switch means is not actuated, and hence the signal lamp is not energized, when only one of said control elements is energized, said switch means is actuated to energize the signal lamp from the vehicle battery and when both said control elements are energized, said switch means is not actuated to thereby prevent said signal lamp from being energized.

2. An adapter unit as claimed in claim 1 wherein said first and second control elements comprise first and second relay coils respectively.

3. An adapter unit as claimed in claim 2 wherein said first and second relay coils are disposed in a common magnetic flux path such that when both are energized, their magnetic fluxes substantially cancel each other.

4. An adapter unit as claimed in claim 3 wherein said switch means comprises a single set of normally open contacts which close when one of said relay coils is energized.

5. A vehicular lighting system comprising:

a set of three lamp loads;

means including a switch means operatively coupling the first of said lamp loads with a source of electrical power of the vehicle such that energization of said first lamp load from said source is controlled by said switch means;

means including a second switch means and a flasher means operatively coupling the second of said lamp loads with said source such that energization of said second lamp load from said source is controlled by said second switch means and said flasher means;

means including a controlled switch means electrically coupling the third of said lamp loads with said source, and not with said first-mentioned means nor said second-mentioned means, such that actuation of said controlled switch means causes said third lamp load to be energized from said source; and means for controlling the actuation of said controlled switch means comprising means operatively coupling said controlled switch means and the first two of said lamp loads such that when neither of said first two lamp loads is energized, said controlled switch means is not actuated; when only the first lamp load of said first two lamp loads is energized, said controlled switch means is actuated; when only the second load of said first two lamp loads is energized, said controlled switch means is actuated; and when both said first and second lamp loads are concurrently energized, said controlled switch means is not actuated.

* * * * *